United States Patent [19]

Haliewicz

[11] 4,164,289

[45] Aug. 14, 1979

[54] LOGGING CARRIAGE

[76] Inventor: Emil Haliewicz, Rte. 1, Box 1407, Hermiston, Oreg. 97838

[21] Appl. No.: 818,550

[22] Filed: Jul. 25, 1977

[51] Int. Cl.[2] ..... B66C 21/00; B61B 7/00; F01B 25/14

[52] U.S. Cl. ..... 212/122; 104/113; 104/183; 212/76

[58] Field of Search ..... 212/76–123, 212/71–75; 104/112–114, 183

[56] References Cited

U.S. PATENT DOCUMENTS

| | | | |
|---|---|---|---|
| 3,247,933 | 4/1966 | Hanna | 212/76 |
| 3,499,544 | 3/1970 | Kolpe | 212/76 X |

*Primary Examiner*—Albert J. Makay
*Assistant Examiner*—R. B. Johnson
*Attorney, Agent, or Firm*—James D. Givnan, Jr.

[57] ABSTRACT

A logging carriage is mounted by hinged sheaves for travel along an elevated cable for the conveyance of felled logs to a log unloading site. The carriage is moved in one direction along the elevated cable by an in haul line which is attached at one end to a powered drum in a yarder. The carriage is moved under the force of gravity in a second direction. The other end of the inhaul line is attached to a spring powered rotatable drum structure mounted on the logging carriage. A drop line for raising and lowering felled logs is mounted on a portion of the spring powered rotatable drum. The spring powered rotatable drum structure is actuated by a compressed air actuated brake assembly. A clamp assembly is mounted on the logging carriage and is selectively engageable with the elevated cable to lock the logging carriage in a preselected position along the cable. The clamp and brake assemblies are controlled by solenoid valves and a radio receiver mounted on the logging carriage. The radio receiver and an air compressor are mounted on the logging carriage and are powered by a pulley and sprocket assemblies which are actuated in response to movement of the logging carriage along the elevated cable.

11 Claims, 11 Drawing Figures

2
3
29
31
1

10
22
21
17
16
13
2
55
62
76
8
75
73
74
58
58A
3
4
20
25
24
19
31
50
47
11
T
32
12
26
29

10
17
23
14
13
15
12
2
24
11

LOGGING CARRIAGE

BACKGROUND OF THE INVENTION

The present invention concerns logging carriages of the type supported for travel along an elevated cable for the conveyance of felled logs to a log unloading site.

The term carriage in the logging industry denotes generally an elevated car from which a drop line is suspended for securement about a log or logs with the car being powered along its supporting cable to a log unloading site by an in-haul drum equipped yarder. The carriage may be outwardly positioned along the elevated cable by gravity or by the drum controlled line reversed through a remote sheave. Commonly carriages also include ratio controlled clamping mechanisms momentarily securing the carriage in place to its supporting cable while the drop line is being retrieved to the carriage with attached log or logs, termed side haul pulling. The prior art includes carriages having sizable internal combustion engines therein for the paying out and retrieving of the drop line carried by engine driven, carriage mounted drum. A variation of this latter arrangement is found in U.S. Pat. No. 3,083,839 wherein a carriage mounted engine serves simply to pay out or "throw slack" in the drop line with subsequent retrieval of the loaded drop line being accomplished by means of a powered yarder drum thereby permitting a carriage engine of lower horsepower with a weight reduction in the carriage and hence an increased "payload" over the first mentioned carriages. Also utilized in carriages is a radio controlled brake to hold the drop line and its load in fixed relationship to the carriage during yarding of the carriage and load to the log discharge site.

SUMMARY OF THE PRESENT INVENTION

The present invention is embodied in a carriage having a novel multiple sheave drum assembly powered in a slack throwing direction for drop line pay out by drum spring components while opposite or slack pulling drum rotation is accomplished by the yarder powered in-haul line spooled about said drum.

The carriage is adapted for travel back and forth along an elevated cable, termed a skyline, in response to the yarder powered in-haul line which is attached directly to the carriage, or via a remote sheave about which the haul back line is reversed back to the carriage and termed a straw line. The latter provides for uphill carriage travel away from the yarder in a downhill logging operation. The present carriage is usable with various cable riggings as found in different logging situations.

The carriage includes a novel skyline clamping assembly wherein cable engaging primary clamps are urged after initial cable contact, into further cable engagement by backup clamps and cooperating inclined surfaces on each set of primary and backup clamps. Said primary clamps are adapted for limited horizontal and inward movement relative to the remaining components of the clamping assembly. A positive lock is achieved by the clamping assembly enabling the carriage to withstand the substantial loads encountered. A further feature of the clamping assembly resides in its capability to grip cables with diameters ranging from approximately one to one and a half inches upon a simple adjustment being made.

The drum assembly of the carriage includes an internal spring case to which the outer ends of a series of springs are attached with the spring inner ends secured in place to a stationary carriage drum shaft. Spring action on the drum serves to pay out the drop line to enable a worker to secure the slackened line about a log or logs preparatory to side haul pulling of the log load to the carriage proximity. The side haul pulling of the load is achieved with power supplied by the yarder haul back drum which powers the double sheaved carriage drum in a direction retrieving the drop line. Accordingly no engine is required in the carriage with the resulting weight reduction enabling greater carriage load capacity and less costly rigging. A brake on the carriage prevents drum rotation during haul back of the load supporting carriage to the yarder or unloading site.

Important objects of the present invention include: the provision of a carriage wherein spring components rotate a carriage mounted double sheave drum to pay out a drop line enabling its attachment to logs remote from the carriage with opposite drum rotation and log retrieval being by a yarder drum and associated in-haul line which, in addition to accomplishing the log retrieving side haul pull to the carriage, reloads the spring components; the provision of a carriage of lighter weight than engine equipped carriages to effect operational economy by greater load capacity and less costly skyline rigging; the provision of a carriage having a clamp assembly wherein skyline clamping members are biased into further cable engagement by interaction between clamp components having cam-like surfaces inclined to the cable axis; the provision of a clamp assembly readily adjustable to engage skyline cables of different diameters; the provision of a carriage readily detachable from a supporting skyline cable.

DETAILED DESCRIPTION OF THE PREFERRED EMBODIMENT

Figure 1:
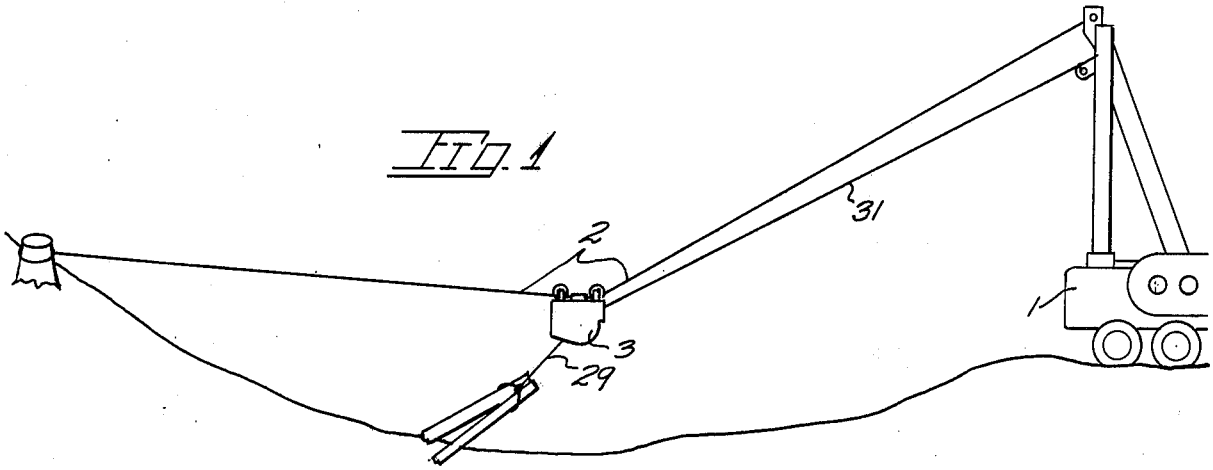
FIG. 1 is a view of a typical skyline logging operation.

With attention to the drawings, the reference numeral 1 indicates remote powered means showing a conventional yarder having multiple powered drums about which cables are spooled, the number of drum and cable combinations determined by the type of logging operation. In FIG. 1 a skyline logging operation is shown having an elevated cable or skyline 2 on which is entrained a carriage 3 which embodies the present invention. A haul back or in-haul line 31 controls carriage return travel. Many riging variations are used in the logging of hilly terrain to control carriage 3 in the desired manner with the present carriage being compatible with various rigging setups.

Figure 2:
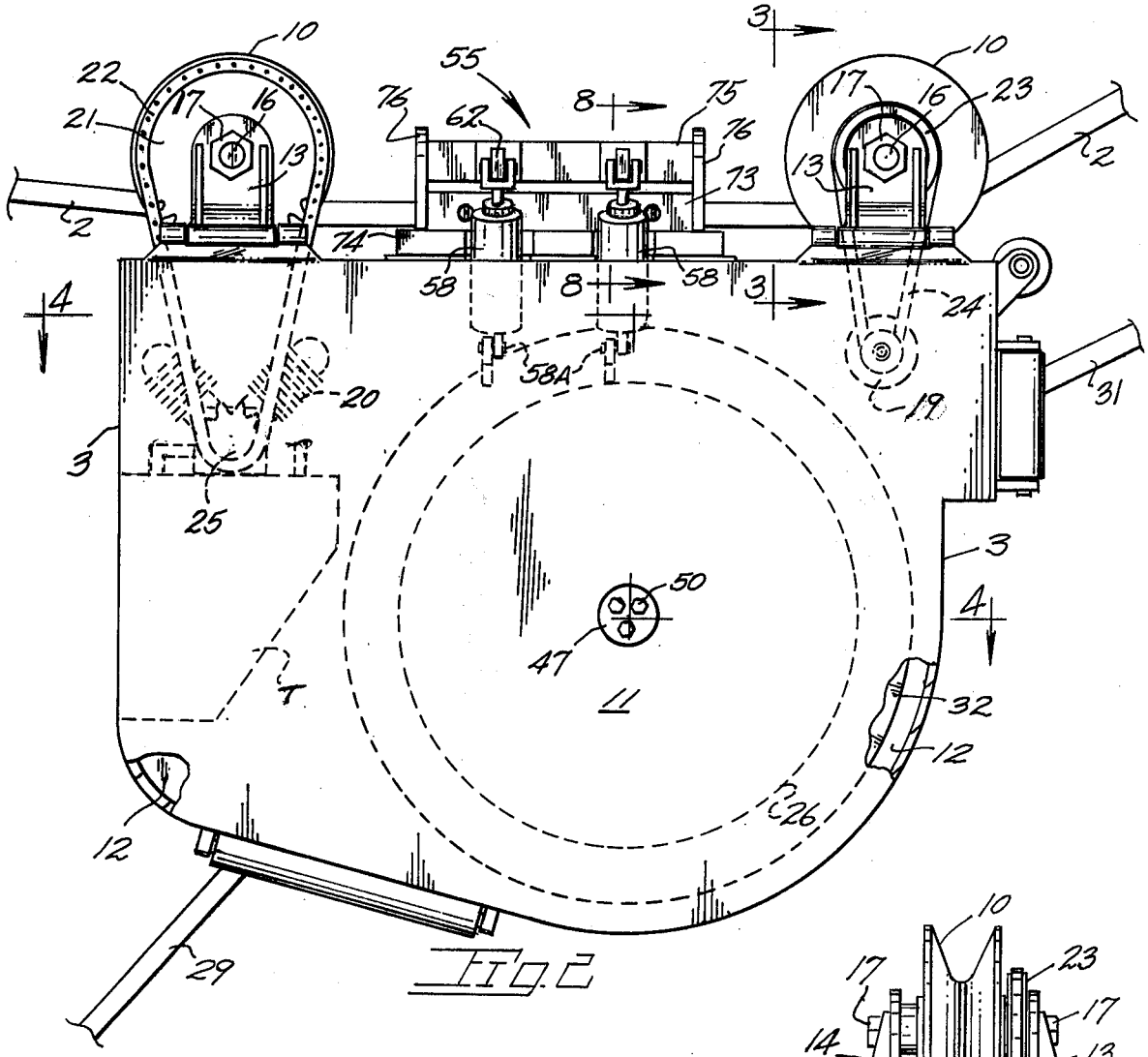
FIG. 2 is a side elevational view of the present carriage.
Figure 3:
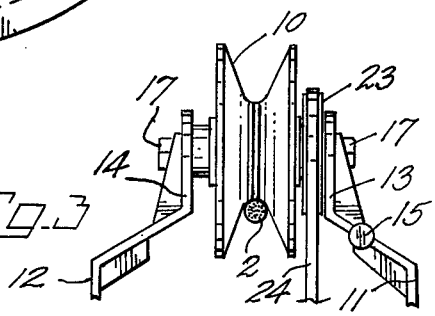
FIG. 3 is a vertical section taken along line 3—3 of FIG. 2 showing details of a skyline entrained sheave.

With attention to FIGS. 2 and 3, a pair of rotatable sheaves at 10 support the carriage for travel on cable 2. Side plates of the carriage at 11 and 12 support pairs of bearing equipped brackets as at 13 and 14 in FIG. 3. Bracket 13 of each pair is provided with a hinge at 15 to enable separation of the bracket upper portion from a sheave supporting shaft at 16 upon removal of a nut element 17. Opening of the hinged bracket 13 of each pair of brackets and of a later described clamp assembly enables the attachment of the carriage to a cable at any point therealong.

For purposes of powering an air compressor at 20, a sprocket 21 is keyed to a sheave shaft 16 with a sprocket entrained roller chain 22 coupled to a driven sprocket 25 on the compressor drive shaft. Similarly, as shown in FIG. 3, a pulley 23 carried by remaining sheave shaft 16 receives a V-belt 24 in driving connection with a 12V alternator 19 providing power for a radio receiver and electrically operated components as later described. From the above it will be seen that the carriage travel along skyline 2 will power both the compressor and the alternator. An air tank at T is at all times charged by compressor 20 while alternator 19 serves to charge a wet cell storage battery 80 (FIG. 11) in the carriage.

Figure 4:
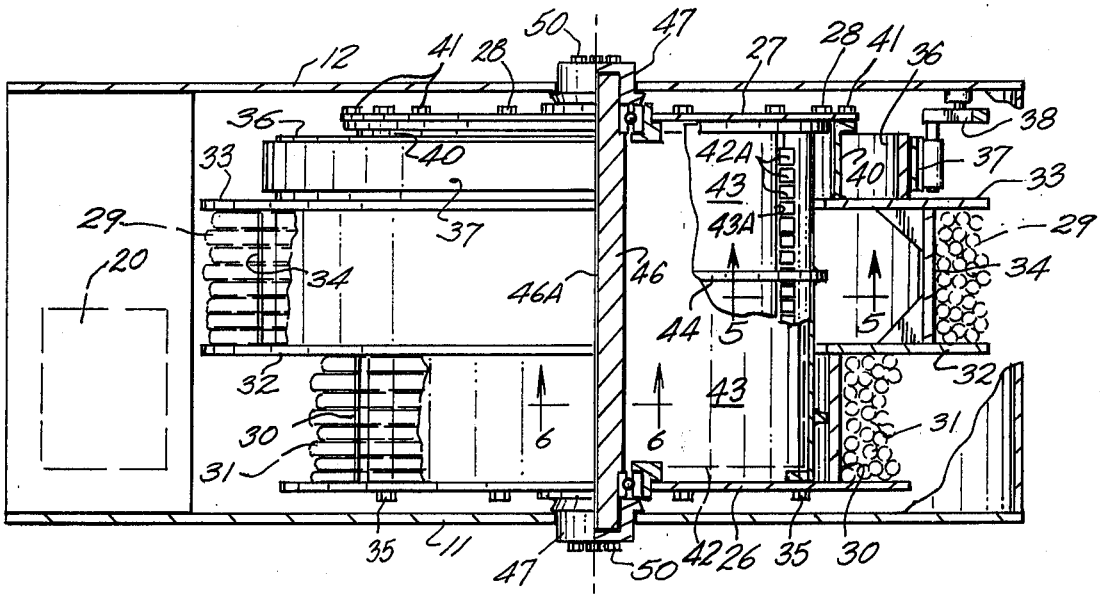
FIG. 4 is a horizontal sectional view of the carriage taken along irregular line 4—4 of FIG. 2 showing drum details.

A drum assembly is best viewed in FIG. 4 and comprises a drum structure having circular end plates 26 and 27 and a first sheave 30 on which is wound the wire rope or cable termed an in-haul line at 31. The in-haul line is in spooled engagement at its remote, unseen end with the powered in-haul drum of yarder 1 which drum imparts rotation, in one direction, to the carriage drum assembly assuming a later described drum brake is in the off position. In-haul sheave 30 is additionally defined by drum flange 32. The latter drum flange serves also to define the lateral limit of a second or drop line sheave 34 for a drop line 29, the remaining side of which sheave is defined by another drum flange 33. Welded on place on flange 33 is an internal brake drum 36 which co-acts with a circular brake band 37, actuated by an air cylinder 39 (FIG. 11) and a brake lever 38. One end of brake band 37 is fixedly mounted to carriage side plate 12 by means of a post (not shown) to permit brake band contraction to lock the drum against rotation.

With continuing attention to the drum assembly, the unseen ends of the in-haul line 31 and drop line 29 are attached to sheave 30 and sheave 34 by conventional means of such as an irregular opening therein permitting securement thereto of the cable ends.

A drum shaft 46 is supported at its reduced ends within cups 47 secured in place within the carriage side plates 11 and 12. Each cup receives a reduced end of drum shaft 46 which, in turn, receives end mounted bolts 50 which secure shaft 46 against rotation after the initial winding of in-haul line 31 thereon.

Figure 6:
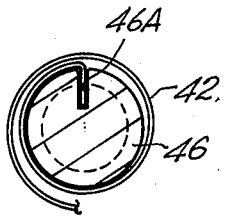
FIG. 6 is a sectional view of the drum shaft and an attached spring end taken along line 6—6 of FIG. 4.
Figure 5:
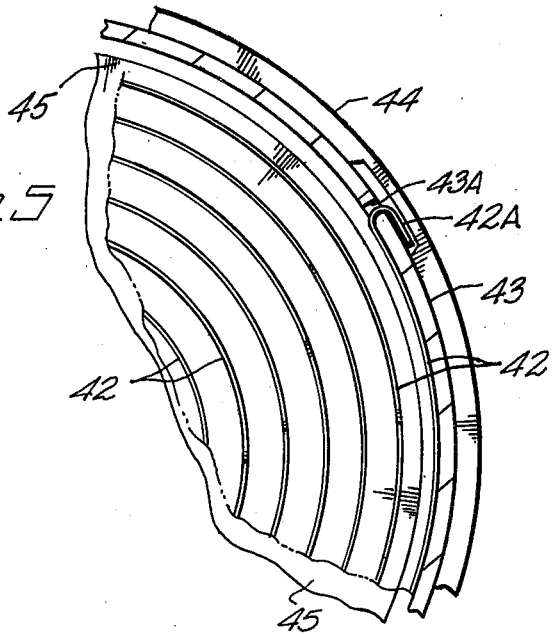
FIG. 5 is a fragmentary elevational view of the reinforced spring case taken along line 5—5 of FIG. 4.
Figure 7:
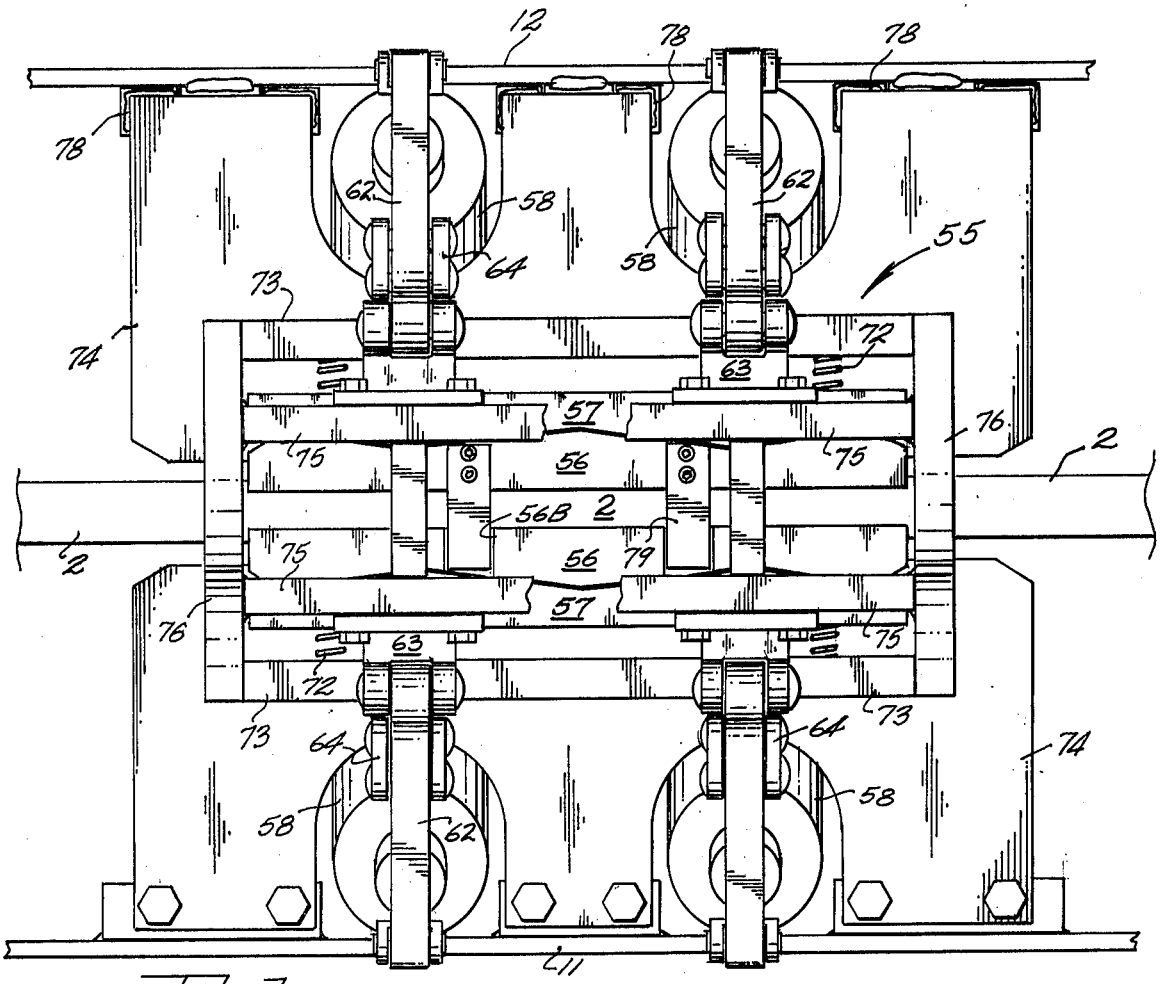
FIG. 7 is a plan view of the clamp assembly.
Figure 9:
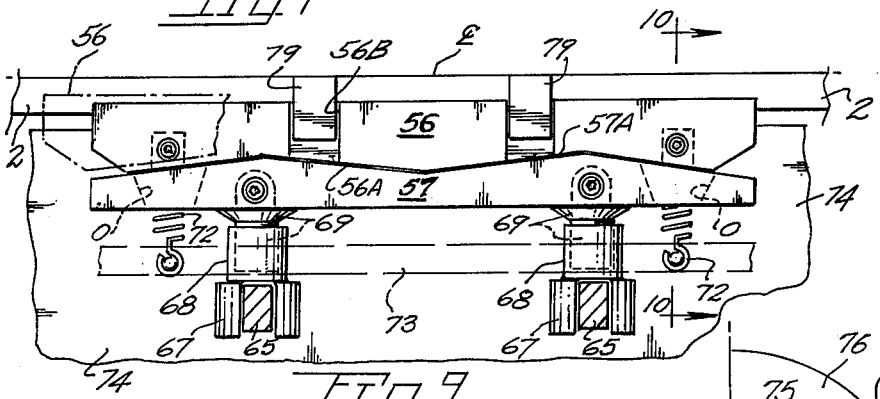
FIG. 9 is a plan view of one set of primary and backup clamp components.

For imparting rotation to the drum assembly, opposite to the direction of rotation imparted by an in-haul line 31, I provide a series of radial coil or motor springs 42 within a cylindrical spring case 43 slotted along its length at 43A to permit the sliding reception of the outer, reversed spring ends at 42A. As shown in FIG. 6, a shaft groove 46A receives the inner ends of coil springs 42. A series of bolts 28 secures one end of the case to drum end plate 27 while a second series of bolts 35 secures the remaining case end to end plate 26 of the drum structure. Bolts 41 secure drum end plate 27 to a circular drum member 40. Springs 42 are isolated from one another by discs or spacers 45. Rings 44 reinforce the spring case. To initially tension the coil springs 42, after securing shaft 46 against rotation, previously wound in-haul line 31 is unspooled from the sheave 30 by a yarder tensioning operation while drop line 29 is simultaneously wound about sheave 34. During the initial tensioning, the carriage 3 is clamped to cable 2.

Figure 10:
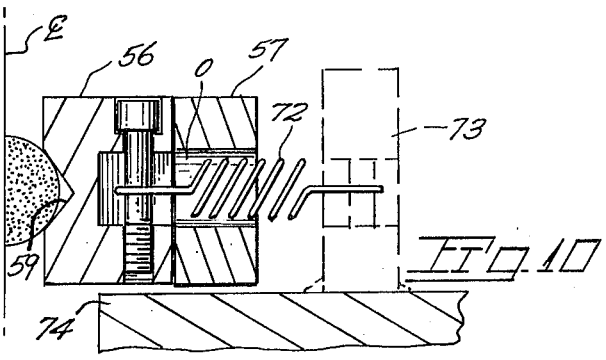
FIG. 10 is a vertical section taken along line 10—10 of FIG. 9 showing clamp details.
Figure 8:
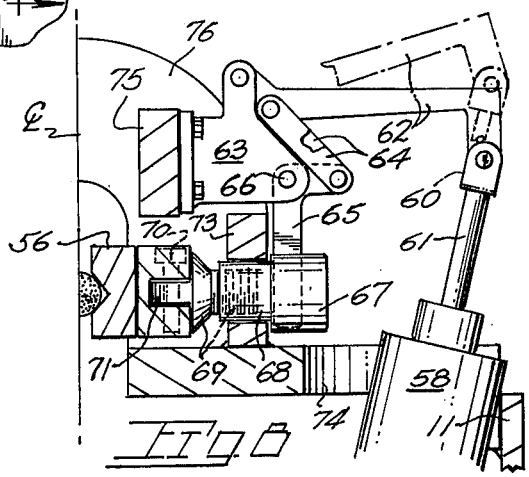
FIG. 8 is a sectional elevational view taken along line 8—8 of FIG. 2 typically showing a clamp linkage.

A clamp assembly is indicated generally at 55 and serves to lock the carriage to supporting skyline cable 2 during the side haul pulling of logs to carriage proximity preparatory to carriage travel along the skyline. As best shown in FIGS. 7 through 10, clamp assembly 55 includes opposed sets of clamps each set being of a segmented nature and positioned into skyline cable engagement by pneumatic cylinders at 58. Primary clamps at 56 are relieved at 59 (FIG. 10) along their length for the purpose of cable engagement. Each clamp set also includes a backup clamp 57. Cooperating surfaces 56A–57A (FIG. 9) on the primary and backup clamps are inclined with respect to the cable 2 axis for purposes later elaborated upon. Actuating each set of clamps I provide double acting pneumatic cylinders 58 with each pair of cylinders being pivotally linked at 58A (FIG. 2) to its respective carriage side plate. In a typical linkage, a rod end 60 of a piston rod 61 is in pivoted connection with a lever 62 which in turn is supported by a bracket 63. A pair of links 64 on arm 62 serve to control a bell crank 65 about a pivot 66 with the arm of the bell crank being received within a bifurcated head 67 of an adjustable clamp positioning assembly including a slidable, internally threaded boss 68, a threaded insert 69 which is coupled to a back-up clamp 57 by a machine screw 70. A tang 71 on insert 69 is apertured to receive said machine screw. To enable use of the present clamp assembly and carriage on different diameter skyline cables, the threaded boss 68 may be axially adjusted from its position shown in FIG. 8 upon temporary removal of arm 65 from bifurcated head 67. The foregoing clamp structure and linkage is retracted away from the cable 2 by springs 72 secured at their outer ends to rigid clamp frame members 73 as best seen in FIG. 10. The clamp frame includes bracket supports 75 and end members 76, the latter secured to a clamp base 74 hingedly mounted at 78 to carriage sidewall 12. Springs 72 extend through backup clamps 57 and specifically through conical openings O therein which permit spring displacement during relative lateral movement between a primary clamp 56 and its backup or secondary clamp 57. From the foregoing it will be seen that primary clamps 56 will be urged into further cable contact upon slight, relative lengthwise movement occurring between the primary and backup clamps of each set. Accordingly, upon initial engagement of primary clamps 56 with the cable sides, horizontal loads imparted to the carriage by the suspended log or logs results in the secondary clamps imparting further inward movement to primary clamps 56 by reason of the inclined, abutting surfaces 56A and 57A. To assure uniform lateral movement (movement parallel to the cable axis) of primary clamps 56, a pair of guides are provided at 79 which are carried by one of said primary clamps and extend into sliding engagement with recesses 56B formed in the remaining primary clamp.

Figure 11:
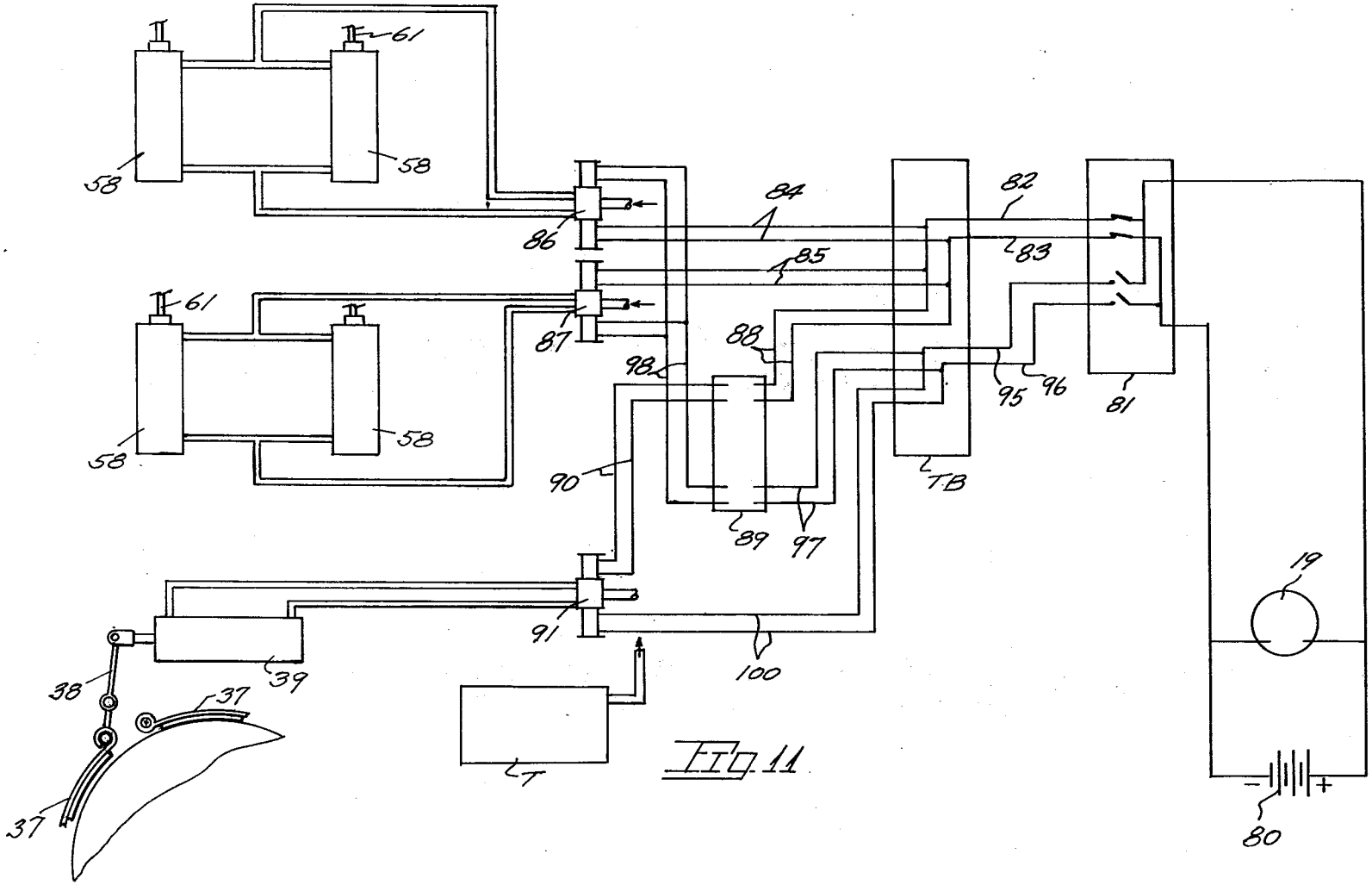
FIG. 11 is a schematic of the carriage electrical system.

With attention now to FIG. 11, a power source is indicated at 80 in the form of a storage battery in parallel with alternator 19 to provide a source of power to a radio receiver 81. Receiver 81 is of the type including switch means comprising pairs of contacts closable upon reception of different frequency signals from a transmitter controlled by a worker. A "clamp on - brake off" circuit includes positive and negative leads 82, 83 to a terminal block TB from which branch circuits at 84 and 85 providing power to solenoid valves 86 and 87. Said valves are of the double solenoid type with energization of the solenoid components thereof served by circuits 84 and 85 positioning the valve cores so as to cause retraction of piston rods 61 of each pneumatic cylinder 58. A third branch circuit at 88 terminates at a relay 89 which relay may be termed a delay relay in that it provides a delay to certain solenoid valves to insure a desired functional delay between drum brake and cable clamp assembly operation. A circuit at 90 connects relay 89 with a solenoid 91 of the double solenoid type to control pressurized air to one end of double-acting brake cylinder 39. Accordingly, upon a "clamp on - brake off" signal being received by receiver 81 of the remote control system for the carriage, the solenoids 86 and 87 will be actuated by the earlier described circuitry to immediately actuate pneumatic cylinders 58 to actuate the two sets of cable clamps and secure the carriage to cable 2. The drum assembly is also released for rotation with delay relay 89 providing a somewhat later closure of circuit 90. Delay relay 89 assures securement of the carriage to cable 2 prior to release of the spring powered drum to prevent the drum from moving the carriage by reason of retrieval of in-haul line 31.

The "clamp off - brake on" circuit leads are indicated at 95–96 from which a branch circuit 97 extends to delay relay 89 while an additional circuit at 98 connects the delay relay with those solenoids of valves 86 and 87 associated with a clamp release position. A circuit 100 intermediate terminal block TB and brake solenoid 91 provides for instantaneous brake application to terminate drum rotation slightly prior to the release of the cable clamps which are controlled by the above-mentioned circuits 97,98 and time delay relay 89. Accordingly, the drum structure is secured against rotation within the carriage prior to travel of the carriage along cable 2 during retrieval of the carriage by the yarder in-haul drum.

In operation, assume the carriage is located at an off-loading point adjacent the yarder, the subsequent slacking of in-haul line 31 permits the carriage to move gravitationally to the site along skyline 2 closest to the load to be transported. In downhill logging operations, a third line would be used associated with a yarder powered drum which line is termed a straw line and extends outwardly to a remotely positioned sheave and thence back to the carriage thereby permitting uphill carriage travel upon straw line retrieval by the yarder. For outward travel of the carriage away from the yarder 1, a signal is transmitted to radio receiver 81 to effect a "clamp-off - brake-on" position of the carriage to permit carriage travel while the drum structure with drop line 29 wound thereon is locked against rotation. Upon carriage positioning at a selected point along skyline 2, a second radio transmitted signal will cause actuation of the clamps and release the drum brake whereupon the drop line will be paid out by action of the drum springs 42. Positioning of the carriage along skyline 2 will be in the typical manner by the yarder operator. During drum rotation incident to paying out of the drop line, a length of in-haul line 31 will be retrieved by the drum as permitted by the yarder in-haul drum being in a free-spooling condition. The length of drop line paid out is controlled by the yarder operator who, upon receiving a certain signal from the ground worker, will brake the yarder in-haul drum to prevent further pay-out of the in-haul line thereby stopping carriage drum rotation. The choker setter, after accomplishing securement of the drop line 29 about a log or logs preparatory to accomplishing the side-hill pull, will signal the yarder operator to commence retrieval of in-haul line 31 which, in view of the carriage being secured to skyline 2, will impart rotation to the drum structure and retrieval of drop line 29 about drum sheave 34. A later signal to the yarder operator will terminate yarder retrieval of in-haul 31 signifying the completion of the side-haul pull with the load now in carriage proximity. The transmission of another signal to receiver 81 effects closure of circuit 97, 98 and 100 putting the carriage in a "clamp-off - brake on" condition which permits carriage retrieval toward the yarder with the suspended load being held by the fully braked carriage drum. Travel to the off-loading site adjacent to the yarder is accomplished in this condition with off-loading at the yarder permitted by return of the carriage electrical control system to the first described "clamp-on - brake off" condition whereby the partially suspended load will be lowered to the ground in a controlled manner for disengagement of the load and drop line.

While I have shown but one embodiment of the invention it will be apparent to those skilled in the art that the invention may be embodied still otherwise without departing from the spirit and scope of the claimed invention.

Having thus described the invention what is claimed and desired to be secured under a Letters Patent is:

1. A carriage for elevated travel along a length of supporting cable, said carriage operable in conjunction with remote powered means to transport a carriage suspended load from an on-loading point to an off-loading point, said carriage comprising in combination, a main carriage body, rotatable sheaves on said carriage body for entrainment on said supporting cable, a clamp assembly on said carriage body including cable clamping members connected by actuating links to pneumatic cylinders and operable to temporarily immobilize the carriage body on the supporting cable, a carriage electrical system including a radio receiver with switch means actuable upon reception of certain radio frequencies, solenoid valves in circuit with said switch means and operable to control said clamp assembly and a brake means, a drum assembly including a drum shaft carried by said carriage body, said drum assembly including, a rotatable drum structure, a first sheave area on said drum structure about which an in-haul cable is wound, said in-haul cable having its remote end spooled about a powered drum on said remote powered means, a second sheave area on said drum structure about which a load attachable drop line is wound, a spring case with multiple springs, said case coupled to said drum structure and operable to rotate the latter to pay out the drum carried drop line for load attachment purposes while simultaneously retrieving said in-haul line, said drum structure rotatable by the in-haul line powered by the remote powered means during the retrieval of the load attached drop line during a side-haul pulling of the load to carriage proximity, said in-haul cable thereafter operable to retrieve the load supporting carriage to the powered means for off-loading purposes, and said brake means operable intermediate the carriage main body and the drum structure to selectively brake said drum structure against rotation during carriage travel.

2. The carriage claimed in claim 1 wherein said switch means includes electrical contacts closable upon the reception of a certain frequency signal, said electrical contacts in circuit with the solenoid valves resulting in the immediate actuation of the clamping assembly securing the carriage to the skyline, said electrical contacts also in circuit with a brake solenoid valve via a delay relay for delayed release of the drum brake.

3. The carriage claimed in claim 2 wherein said switch means includes additional contacts closable upon the reception of a second frequency signal, said additional contacts in circuit with said solenoid valves via a delay relay for timed delay release of the cable clamping assembly, said additional contacts also in circuit with the brake solenoid valve to assure locking of the drum brake prior to release of the clamping assembly.

4. The carriage claimed in claim 1 wherein said clamping assembly includes opposed sets of cable clamping members, each of said sets including a primary clamp and a backup clamp, said clamping members of each set having cooperating surfaces inclined to the cable axis to effect clamping movement of the primary clamping members upon relative movement between the clamping members of each set.

5. The carriage claimed in claim 4 further including elongate coil springs connected at one end thereof to said carriage and at the other end thereof to said primary clamping members whereby said primary clamping members are resiliently mounted to permit their retraction away from the cable by spring action as well as a limited lengthwise displacement relative to their respective back up member.

6. The carriage claimed in claim 5 wherein the primary clamping members of each set have cooperating guide members guiding said primary clamping members toward and away from said supporting cable whereby said clamping members are connected to assure like displacement of same from their respective back up clamps.

7. The carriage claimed in claim 6 wherein each set of clamping members is coupled in an adjustable manner to clamp actuating linkage.

8. The carriage claimed in claim 1 wherein said rotatable sheaves and said clamping assembly include hinge components enabling lateral insertion of a supporting cable segment whereby the carriage may be applied to or removed from a mid-point of said supporting cable.

9. The carriage claimed in claim 1 wherein said multiple springs are axially spaced radial coil springs having reversed outer ends and said spring case defines a slot extending in a lengthwise direction along the case to receive the reversed outer ends of said springs and said coil springs having the inner ends thereof received in a groove in said drum shaft.

10. The carriage claimed in claim 9 wherein said case includes reinforcing rings.

11. The carriage claimed in claim 10 additionally including spacers isolating the springs from one another.

* * * * *